US005685018A

United States Patent [19]

West

[11] Patent Number: 5,685,018

[45] Date of Patent: Nov. 11, 1997

[54] DISPOSABLE PERM RINSING CAP

[76] Inventor: Charlie M. West, 6508 Wilgrove Minthill Rd., Charlotte, N.C. 28227

[21] Appl. No.: 640,173

[22] Filed: Apr. 30, 1996

[51] Int. Cl.[6] ..... A45D 19/00; A45D 19/14; A42B 1/06

[52] U.S. Cl. ..... 2/174; 2/171; 2/209.14; 2/182.8; 4/515; 4/520; 4/521

[58] Field of Search ..... 2/174, 171, 171.03, 2/171.3, 171.7, 181.2, 182.3, 209.14, 209.7, 209.5, 182.8; 4/515, 520, 521; 132/212, 270

[56] References Cited

U.S. PATENT DOCUMENTS

| | | | |
|---|---|---|---|
| 3,040,336 | 6/1962 | Plank | 4/521 |
| 3,327,720 | 6/1967 | Carmony et al. | 2/182.8 |
| 4,289,150 | 9/1981 | Kimball | 132/7 |
| 4,357,951 | 11/1982 | Aricco | 132/7 |
| 4,724,852 | 2/1988 | Ramik | 132/7 |
| 5,099,865 | 3/1992 | Flannery et al. | 132/7 |
| 5,235,709 | 8/1993 | Terlep | 4/515 |
| 5,551,088 | 9/1996 | Stepp | 2/174 |

*Primary Examiner*—Jeanette E. Chapman

*Attorney, Agent, or Firm*—Patent & Trademark Services, Inc.; Joseph H. McGlynn; Thomas Zack

[57] ABSTRACT

A flexible protective transparent cap to be placed on the head of a user when receiving hair treatment. Holes are provided in the cap's housing to allow for the operator's use, to place the cap on the user and to discharge excess liquids. The discharge outlet holes consists of two distinct sets of holes with one set having larger sized holes placed near the bottom of the cap when in use.

3 Claims, 1 Drawing Sheet

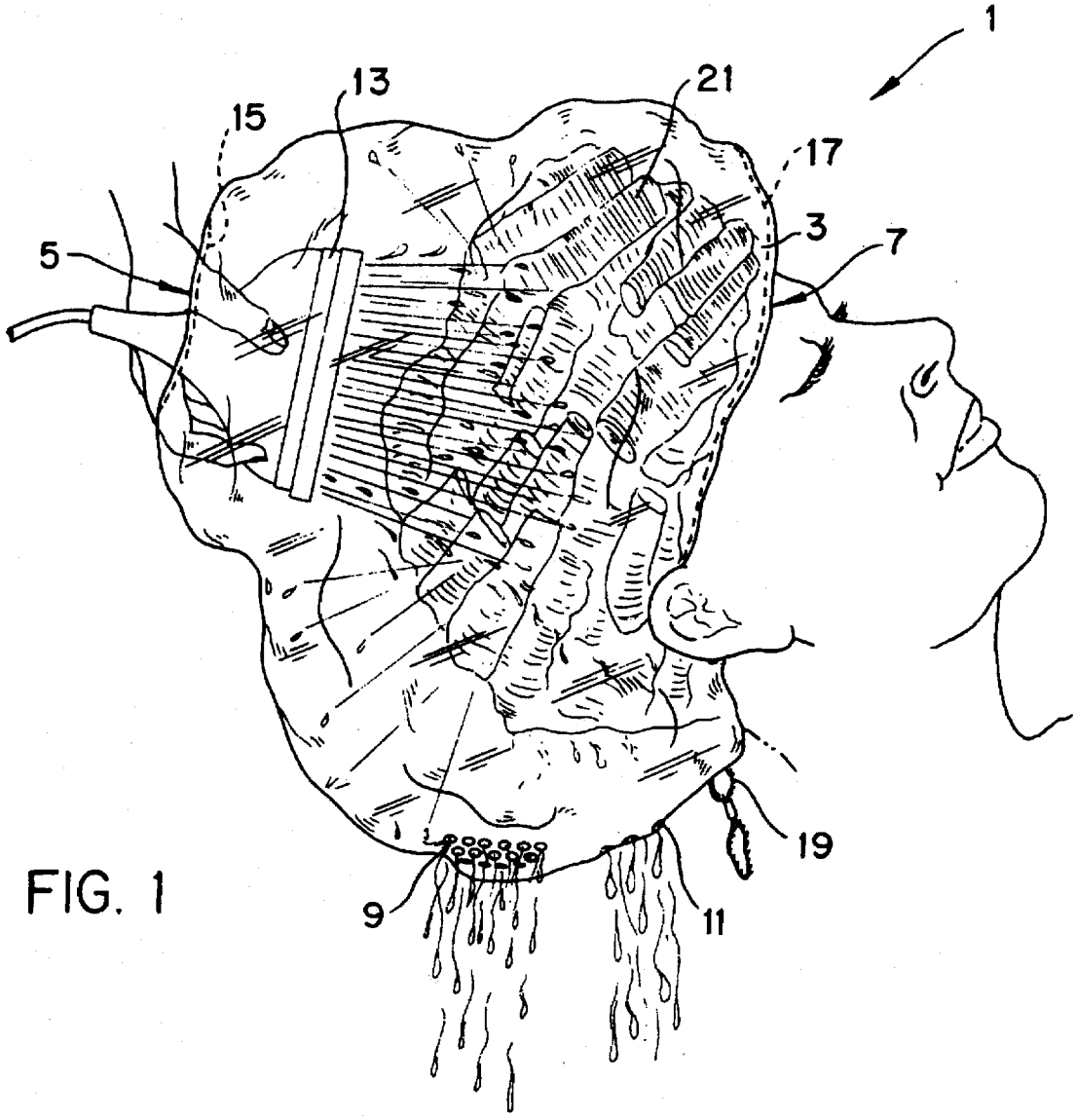
FIG. 1
FIG. 2
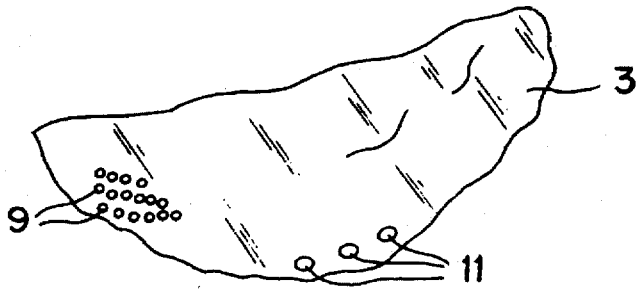

DISPOSABLE PERM RINSING CAP

BACKGROUND OF THE INVENTION

The present invention relates to a disposable cap used to protect a user from water and harsh chemicals used in various hair treatment operations. The disclosed embodiment illustrates the application of this invention when conducting the rising segment of a hair permanent operation. The disclosed protective rising cap used in the manner described provides protection from applied liquids as excess liquids are directed away from the user by a series of different sized holes placed at selected locations in the cap.

DESCRIPTION OF THE PRIOR ART

In the prior art various types of protective disposable caps are known. For example, U.S. Pat. No. 5,099,865 to Rita Flannery and May Henry discloses a flexible hood having an opening to fit the user's head and a second inlet to allow the introduction of water and shampoo. FIG. 6 therein describes a water collecting pocket 30 with an integrally formed extension to provide for the collection and run-off of water and shampoo. Essentially this reference differs from the present invention by providing for only one drain hole in the formed extension and by requiring an additional extension not integral with the cap. Other protective caps—as disclosed in the U.S. Pat. Nos. 4,289,150 to David D. Kimball, 4,357,951 to Ronald A. Aricco and 4,724,852 to Vincent L. Ramik—do not provide for both the protection of the user and the diverting of applied excess liquids in one simple unit as described and claimed herein.

SUMMARY OF THE INVENTION

The present invention consists of a disposable transparent flexible liquid impervious protective cap used in hair treatment operations. Excess applied liquids are diverted away from user's hair by a series of different sized hole sets placed at selected locations in the cap. Flexible adjustable attachment means provide for the cap's placement and holding to a user. There is also an adjustable attachment means to secure the cap to an the operator who introduces liquids to the use's head It is an object of the present invention to provide an improved disposable hair treatment cap.

It is a further object of the present invention to provide a hair treatment cap which both protects the user from applied liquids and diverts excess liquids away.

It is another object of the present invention to provide a disposable cap which allows for protection of the user and easy placement on the user and easy access by the operator while at the same time providing for the disposal of excess applied liquids.

These and other objects and advantages of the present invention will be fully apparent from the following description, when taken in connection with the annexed drawings.

BRIEF DESCRIPTION OF THE DRAWINGS

FIG. 1 is view of the present invention showing when placed on a user's head as a water rinse is applied.

FIG. 2 is an enlarged view of the present invention illustrating the placement of the drain holes.

DESCRIPTION OF THE PREFERRED EMBODIMENT

Referring now to the drawings in greater detail, FIG. 1 shows the disposable transparent flexible plastic cap 1 forming the subject of this invention on a user's head. The flexible surface 3 forms a housing which continuously encases and protects the user except for the hole openings 5 and 7 and the drain hole sets 9 and 11. Opening 5 allows entrance to the space around the user's head and permits an operator to apply liquid substances such as water from a hand held water rise nozzle 13. An elastic band 15 (shown by the dotted line in FIG. 1) encircling the opening 5 is attached to the cap to provide a snug fit to the operator's hand and insures no liquid will be discharged outside of the housing. The cap's transparent material allows the operator a full view of the user's head during the treatment process.

The larger cap opening 7 is placed around the user's head and over the user's ears as illustrated. A second elastic band 17 is fixed within the housing to encircle this opening and permits this opening to securely encircle the user's covered head portion. A draw string 19 attached to elastic band 17 permits a secure fit and insures that liquids or other excess applied substances will not be discharged on the user's face or body. The illustrated perm rods 21 form no part of this invention and are merely illustrative of one use of my invention.

In the preferred embodiment of this invention the user's head placed backwards on the rim of a sink with the head and cap placed directly over the sink. Introduced excess applied liquids will thus under the force of gravity fall from the user's head to the bottom portion of the cap. Placed within the cap are at least two sets of liquid discharging holes or apertures. The smaller sized hole set 9 is placed higher in the cap while the larger sized hole set 11 is nearer the bottom of the cap. By placing these hole sets in this manner liquids not used will, after contacting the user's head, be discharged into the sink and disposed of without adding much liquid weight to the cap.

FIG. 2 is an enlarged view of the discharge hole sets 9 and 11. In one embodiment three holes form the series of the larger lower hole set 11 although it is apparent this number could vary. Normally the smaller sized higher placed hole set 9 is made up of a series of more holes and functions in the same manner to discharge unwanted liquids to the sink.

In the illustration used of this invention water is applied to rinse a perm solution from perm rods 21. Excess liquid, in this case water, flowing off the user's head is discharged to the hole sets 9 and 11. Once the operation is completed, the cap 1 is taken off the user's head and it is disposed of by the operator. The particular material used to construct the cap chosen was a transparent thin liquid impervious disposable plastic bouffant bag. Other functionally equivalent safe materials could also be used.

Although the disposable cap and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A disposable protective cap adapted for use on a user's head comprising:

a continuous flexible transparent encasing cap housing made of a liquid impervious material having four separate holes sets therein;

the first of said holes sets having a size and shape that is adapted to permit the entry of an operator's hand with a liquid dispensing unit into the interior of the cap housing, said first hole set having a flexible encircling elastic means around its hole opening to prevent liquids from exiting from the cap through this hole set when disposed around the operator's hand;

the second of said cap hole sets having a size and shape that is adapted to receive the upper part of a user's head into the interior of the cap housing, said second hole set having a flexible encircling elastic means around its hole opening to prevent liquids from exiting from the cap through this hole set when disposed around the upper part of a user's head;

the third set of said cap hole sets being adapted to discharge excess liquid introduced through the first hole set by the liquid dispensing unit from the cap housing; and the fourth set of cap hole sets being adapted to discharge excess liquid introduced through the first set by the liquid dispensing unit from the cap housing, said fourth set of cap holes being spaced from the said third set of cap holes and disposed at a lower portion of the cap housing than third set of holes when said cap is on a user's head.

2. The cap as claimed in claim 1, wherein the third and fourth hole sets each consist of a set of at least two holes with the holes in the fourth set being larger than those in the third set.

3. The cap as claimed in claim 2, wherein said fourth hole set consists of three holes and the smaller third hole set consists of a numbers of holes greater than three.

* * * * *